US010669067B1

(12) United States Patent
Paterson

(10) Patent No.: US 10,669,067 B1
(45) Date of Patent: Jun. 2, 2020

(54) TOILETRY ORGANIZER

(71) Applicant: Romance Coach On the Go, LLC, Scottsdale, AZ (US)

(72) Inventor: Camille Joyce Paterson, Carefree, AZ (US)

(73) Assignee: Romance Coach On the Go, LLC, Scottsdale, AZ (US)

( * ) Notice: Subject to any disclaimer, the term of this patent is extended or adjusted under 35 U.S.C. 154(b) by 0 days.

(21) Appl. No.: 16/595,908

(22) Filed: Oct. 8, 2019

(51) Int. Cl.
*B65D 21/08* (2006.01)
*A45D 44/00* (2006.01)

(52) U.S. Cl.
CPC ..... *B65D 21/086* (2013.01); *A45D 44/00* (2013.01)

(58) Field of Classification Search
CPC ..... B65D 21/086; B65D 21/068
USPC ..... 220/8
See application file for complete search history.

(56) References Cited

U.S. PATENT DOCUMENTS

| | | | | |
|---|---|---|---|---|
| 888,554 | A | 5/1908 | Tuttle | |
| 1,252,775 | A * | 1/1918 | Butcher | B65D 21/086 220/8 |
| 2,904,209 | A * | 9/1959 | Murdock, Sr. | F17B 1/00 220/8 |
| 4,534,474 | A * | 8/1985 | Ng | B25H 3/04 206/501 |
| 4,557,378 | A * | 12/1985 | Klebold | B65D 25/44 141/337 |
| 7,591,382 | B2 | 9/2009 | Brock | |
| 9,332,814 | B2 | 5/2016 | Brock | |
| 2011/0248040 | A1 | 10/2011 | McGregor | |
| 2015/0217900 | A1 | 8/2015 | Poulin | |

FOREIGN PATENT DOCUMENTS

| | | | |
|---|---|---|---|
| CN | 2654524 | Y | 11/2004 |
| CN | 201756222 | U | 3/2011 |
| CN | 202085891 | U | 12/2011 |
| FR | 3041557 | B3 | 11/2017 |
| GB | 2429008 | A | 2/2007 |
| JP | 2001039442 | A | 2/2001 |
| KR | 20100012063 | U | 12/2010 |

OTHER PUBLICATIONS

Photographs of Rotary Organizer distributed by Target Corp., © 2011 Target Brands Inc., [6 5/16 in H×5 13/16 in W×5 13/16 in D (16 cm×14.7 cm×14.7 cm)], 081 07 0523 ID091 491-0013.

* cited by examiner

*Primary Examiner* — Jeffrey R Allen
(74) *Attorney, Agent, or Firm* — Banner & Witcoff, Ltd.

(57) ABSTRACT

A cosmetic and toiletry organization apparatus is disclosed, comprising one or more telescopic columns configured with a base column for movement of an uppermost of the telescopic columns between a storage configuration of the apparatus, in which the telescopic columns are nested within the base column, and an extended configuration, in which the at least one of the telescopic columns extends at least partly out of the base column. The uppermost telescopic column may include a plurality of openings that accommodate one or more telescopic storage members for telescopic movement within the openings such that in the extended configuration, the telescopic storage members move downward within the openings, thereby providing storage cavities, which, in the extended configuration of the apparatus, have a depth that is more than a height of the apparatus in the storage configuration.

18 Claims, 14 Drawing Sheets

SECTION B-B

SECTION B-B

SECTION A-A

TOILETRY ORGANIZER

TECHNICAL FIELD

This disclosure generally relates to the technical field of containers for organizing items of daily usage. In particular, it pertains to a cosmetic and toiletry organizing apparatus that can be folded to a smaller size to facilitate storage in travel baggage, thereby enabling a user to organize cosmetic and toiletry items in same fashion both at home and at other locations.

BACKGROUND

A variety of apparatuses for storing cosmetic and toiletry items are available in the market. They are typically designed to store, protect and preserve the items, and at the same time organize the items to allow the user to have easy access to each item. As a large variety of cosmetic items can be used, such apparatuses need to have compartments of different sizes to accommodate the complete range of cosmetic items. For example, there are twenty-eight basic cosmetic categories, each cosmetic category generally having its own specific shape and size.

Some apparatuses may be additionally designed to hold the items such that they are visible and can be easily identified and picked when needed. However, the many travel cosmetic holders may unfold or open in a way that does not allow the user to see all the contents. Therefore, a means for organizing cosmetics while travelling in a visible and familiar set-up would be beneficial.

BRIEF SUMMARY

In view of the foregoing, it is an object of the present invention to provide a solution to the above stated problem faced by women while traveling, by providing a cosmetic and toiletry organizing apparatus that may be used both at home and during travel, thereby providing a familiar set-up for the cosmetic and toiletry items at outstation, and overcoming the drawback of presently available cosmetic and toiletry organizing apparatuses.

Embodiments described herein provide an apparatus for organizing cosmetic and toiletry items that can be used at home, collapsed to a small size for carrying within a suitcase, and upon arriving at the destination, can be pulled to reorganize and secure all the cosmetic and toiletry items in similar fashion as at home.

In an embodiment, an organization apparatus is disclosed having a base; a base column that extends perpendicularly from the base; and one or more columns (hereinafter referred to as telescopic columns) arranged in a telescopic fashion. The one or more telescopic columns include an uppermost telescopic column, and the one or more telescopic columns are configured with the base column for movement of the uppermost telescopic column between a storage configuration of the apparatus and an extended configuration of the apparatus. In the storage configuration of the apparatus, the one or more telescopic columns are nested within the base column, and in the extended configuration, the one or more telescopic columns extend at least partly out of the base column.

The uppermost telescopic column incorporates a plurality of openings. The openings are defined by one or more partition walls configured between opposite interior sides of the uppermost telescopic column.

At least one opening out of the plurality of openings in the uppermost telescopic column accommodates one or more telescopic storage members. The one or more telescopic storage members are configured for telescopic movement within the at least one opening such that when the apparatus is in the extended configuration, the one or more telescopic storage members move downwards within a corresponding opening to provide at least one storage cavity that has, in the extended configuration of the apparatus, a storage cavity depth that is more than a height of the apparatus in the storage configuration.

The one or more telescopic columns may include, besides the uppermost telescopic column, at least one intermediate telescopic column. The intermediate telescopic column may be configured between the base column and the uppermost telescopic column. The intermediate telescopic column results in providing a height in the extended configuration of the apparatus, which is greater than two times the height of the apparatus in the storage configuration.

At least one of the telescopic storage members may comprise a lower storage member and at least one intermediate telescopic storage member. The lower storage member and the at least one intermediate telescopic storage member may be configured such that when the apparatus is in the storage configuration, the lower storage member and the intermediate telescopic storage member nest within the corresponding opening.

The apparatus may include an outer sidewall that extends generally perpendicular to the base along a perimeter of the base. The base and the outer sidewall may define a tray having storage space between the base column and the outer sidewall.

The uppermost telescopic column may include a flange member coupled to upper end of a sidewall of the uppermost telescopic column. At least one storage member may be coupled to the flange member such that the storage member extends outward away from the uppermost telescopic column. There can be a relief gap between outer surface of the sidewall of the uppermost telescopic column and the storage member to enable nesting of the one or more telescopic columns within the base column when the apparatus is moved to the storage configuration.

A top surface of the storage member may be coplanar with the top surface of the flange member.

The storage member may be configured such that in the storage configuration of the apparatus, the storage member is accommodated within the tray without hindering movement of the apparatus to the storage configuration.

The apparatus may also comprise a cover to cover the apparatus in the storage configuration. The cover may engage with the outer sidewalls of the apparatus, and may enable carrying of the apparatus with toiletry items stored in the tray and the storage member.

The telescopic storage members may include an inward projecting flange that, in the extended configuration of the apparatus, contact against an inward extending flange at a lower end of the one or more partition walls to support the telescopic storage members when the apparatus is in the extended configuration.

In another embodiment, the proposed organization apparatus includes a tray having a base and an outer sidewall that extends generally perpendicularly from the base along a tray perimeter, and a telescoping column assembly including a base column, an intermediate telescopic column and an uppermost telescopic column.

The base column is defined by a sidewall that is spaced inward from the outer sidewall and extends upward from the base of the tray. The base column includes a base opening bound by the sidewall of the base column.

The intermediate telescopic column is moveably coupled with the base telescopic column through the base opening of the base column, and is defined by a sidewall. The intermediate telescopic column includes an intermediate opening bound by the sidewall of the intermediate telescopic column.

The uppermost telescopic column is moveably coupled with the intermediate telescopic column through the intermediate opening of the intermediate telescopic column, and is defined by a sidewall. It includes an uppermost opening bound by the third sidewall of the uppermost telescopic column.

The apparatus further includes a flange member connected to an upper end of the third sidewall of the uppermost telescopic column.

A plurality of storage cavities are arranged within the uppermost opening of the uppermost telescopic column, and a first storage cavity of these storage cavities has a first storage cavity depth, which is defined as a vertical distance from a top surface of the flange member to a bottom surface of the first storage cavity.

The apparatus has a storage configuration and an extended configuration, and when the apparatus is in the storage configuration, the first storage cavity depth is less than the first storage cavity depth when the apparatus is in the extended configuration.

When the apparatus is in the storage configuration, the uppermost telescopic column may be nested within the intermediate opening of the intermediate telescopic column, and the intermediate telescopic column is nested within the base opening of the base column.

Each of the base column, the intermediate telescopic column and the uppermost telescopic column may be a tapering column having a larger cross section at a lower end than a cross section at an upper end.

Each of the sidewalls of the base column and the intermediate telescopic column may include an engaging member that protrudes inward, and may be located proximate the top edge of the respective sidewalls. In the extended configuration of the apparatus, the engaging members may prevent the apparatus from collapsing by providing a mechanical stop against downward movement of the sidewall of the uppermost telescopic column relative to the sidewall of the intermediate telescopic column, and the sidewall of the intermediate telescopic column relative to the sidewall of the base column.

The apparatus may further comprise at least one storage member coupled to the flange member extending outward away from the uppermost opening. The storage member may have a top surface that is coplanar with the top surface of the flange member.

Besides the first storage cavity, the plurality of storage cavities may include a second storage cavity, a third storage cavity, a fourth storage cavity, and/or more storage cavities.

The first storage cavity may include a first opening defined by a first partition wall configured between opposite interior sides of the sidewall of the uppermost telescopic column, and a first lower telescopic storage member (also referred to as first lower storage member) that is slidably engaged to an interior surface of the sidewall of the uppermost telescopic column and a first interior surface of the first partition wall. The first lower storage member may include the bottom surface of the first storage cavity.

The second storage cavity may include a second opening defined between the first partition wall and a substantially parallel second partition wall configured between the opposite interior sides of the sidewall of the uppermost telescopic column; an intermediate telescopic storage member slidably engaged to a second interior surface of the first partition wall and a first interior surface of the second partition wall; and a second lower telescopic storage member (also referred to as second lower storage member) slidably engaged to an inner surface of the intermediate telescopic storage member. The second lower storage member may include a bottom surface of the second storage cavity.

The third storage cavity may include a third opening defined between the second partition wall and a substantially parallel third partition wall configured between the opposite interior sides of the sidewall of the uppermost telescopic column; the intermediate telescopic storage member slidably engaged to a second interior surface of the second partition wall and a first interior surface of the third partition wall; and a third lower telescopic storage member (also referred to as third lower storage member) slidably engaged to the inner surface of the intermediate telescopic storage member. The third lower storage member may include a bottom surface of the third storage cavity.

The fourth storage cavity may include a fourth opening defined between the third partition wall and inner side of the sidewall of the uppermost telescopic column, and a fourth lower telescopic storage member (also referred to as fourth lower storage member) slidably engaged to a second interior surface of the third partition wall and the interior surface of the sidewall of the uppermost telescopic column. The fourth lower storage member may include a bottom surface of the fourth storage cavity.

Each of the interior surfaces, and the intermediate telescopic storage members may include an inward projecting flange located near a respective lower end to support a corresponding intermediate telescopic storage member or a corresponding lower storage member in the extended configuration of the apparatus by engaging with an outwardly extending flange of a corresponding intermediate telescopic storage member or a corresponding lower storage member.

The second storage cavity and the third storage cavity respectively may have a second storage cavity depth and a third storage cavity depth defined as a vertical distance from the top surface of the sidewall of the uppermost telescopic column to the bottom surface of the respective storage cavity. When the apparatus is in the extended configuration, the second storage cavity depth and the third storage cavity depth may be more than two times a height of the apparatus in the storage configuration.

When the apparatus is in the extended configuration, a second storage cavity depth may be different than a third storage cavity depth.

When the apparatus is in the storage configuration, all the storage cavity depths may be equal.

In yet another embodiment, a toiletry organization apparatus is disclosed that includes a tray having a base and an outer sidewall extending perpendicularly from the base along a tray perimeter and a telescoping column assembly having a base telescopic column and an uppermost telescopic column.

The base column is defined by a sidewall that is spaced inward from the outer sidewall and extends upward from the base of the tray. The base column includes a base opening bound by the sidewall of the base column.

The uppermost telescopic column is moveably coupled with the base column through the base opening of the base column, and is defined by a sidewall. It includes an uppermost opening bound by the sidewall of the uppermost telescopic column.

The apparatus further includes a flange member connected to an upper end of the sidewall of the uppermost telescopic column, and a plurality of storage cavities arranged within the uppermost opening. Each of the storage cavities has a corresponding storage cavity depth defined as a vertical distance from a top surface of the flange member to a bottom surface of the corresponding storage cavity.

The apparatus has a storage configuration and an extended configuration, wherein when the apparatus is in the extended configuration, the storage cavity depth of at least one of the plurality of storage cavities is greater than a height of the apparatus in the extended configuration.

At least one of the storage cavities may include an interior surface of an opening defined by at least one partition wall configured between opposite interior surfaces of the sidewall of the uppermost telescopic column, and a lower telescopic storage member (also referred to as lower storage member) slidably engaged to one of the interior surfaces of the sidewall of the uppermost telescopic column and a first interior surface of a partition wall. The lower storage member may include the bottom surface of the at least one of the plurality of storage cavities.

The first interior surface may include an inward projecting flange located near a respective lower end to support the corresponding lower telescopic storage member that engages with an outwardly extending flange of the corresponding lower storage member, when the apparatus is in the extended configuration.

The apparatus further may further include at least one storage member coupled to the flange member extending outward away from the uppermost opening. The storage member may be configured such that in the storage configuration of the apparatus, the storage member is substantially accommodated within the tray.

BRIEF DESCRIPTION OF THE DRAWINGS

The embodiments herein will be better understood from the following detailed description with reference to the drawings, in which.

DETAILED DESCRIPTION

Figure 1A:
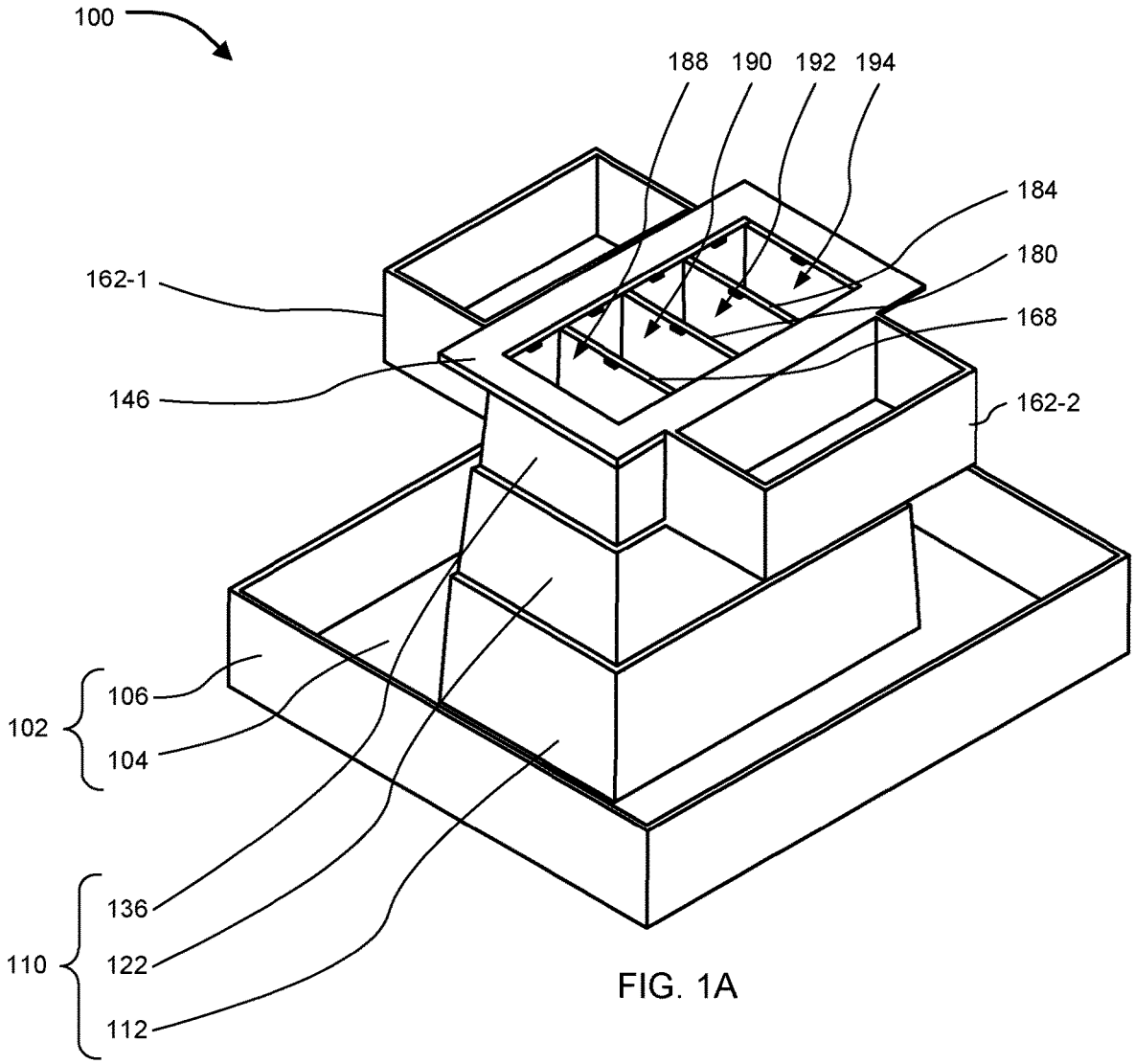
FIG. 1A is an exemplary isometric view of the proposed cosmetic and toiletry organization apparatus in an extended configuration, according to the embodiments described herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein. While the terms "top," "bottom," "front," "back," "side," and the like may be used in this specification to describe various example features and elements of the invention, these terms are used herein as a matter of convenience, e.g., based on the example orientations shown in the figures or the orientation during typical use. Nothing in this specification should be construed as requiring a specific three-dimensional orientation of structures in order to fall within the scope of this invention. Also, the reader is advised that the attached drawings are not necessarily drawn to scale.

The term "include" and variations of the word, such as "including" and "includes" is not intended to exclude other additives, components, integers or steps.

The term "substantially parallel" means that a first line, segment, plane, edge, surface, etc. is approximately (in this instance, within 2%) equidistant from with another line, plane, edge, surface, etc., over at least 50% of the length of the first line, segment, plane, edge, surface, etc.

The term "substantially perpendicular" means that a first line, segment, plane, edge, surface, etc. is approximately (in this instance, within 10 degrees) perpendicular to another line, plane, edge, surface, etc., over at least 50% of the length of the first line, segment, plane, edge, surface, etc.

The term "depth" of the cavities as referred to in the present disclosure refers to a vertical distance from a top surface of the flange to a bottom surface of the cavity.

The term "height" of the apparatus as referred to in the present disclosure refers to a vertical distance from a top surface of the flange member to a bottom surface of the base of the tray of the apparatus.

Additionally, the term "plurality," as used herein, indicates any number greater than one, either disjunctively or conjunctively, as necessary, up to an infinite number.

Referring to FIGS. 1A to 6B, the disclosed cosmetic and toiletry organization apparatus 100 includes a tray 102 having a base 104 and an outer sidewall 106 that extends substantially perpendicular to the base 104 along a tray perimeter. A telescopic column assembly 110 is configured on the base 104, and includes a base column 112, which extends vertically from the base 104, and one or more telescopic columns, such as an uppermost telescopic column 136 and an intermediate telescopic column 122. The uppermost telescopic column 136 and the intermediate telescopic column 122 may be arranged with the base column 112 in a telescopic fashion for nesting within the base column 112, as shown in FIG. 1B and referred to as a storage configuration of the apparatus 100. When pulled out of the base column 112, the uppermost telescopic column 136 projects out of the base column 112, as shown in FIGS. 1A, 2A, 3B, 3C, 4A and 4C, and referred to as extended configuration of the apparatus 100. The storage configuration shown in FIGS. 1B, 2B, 5A, 5B, 6A and 6B corresponds to the configuration in which the apparatus 100 can be packed in travel baggage, such as a suitcase of a user.

Figure 2A:
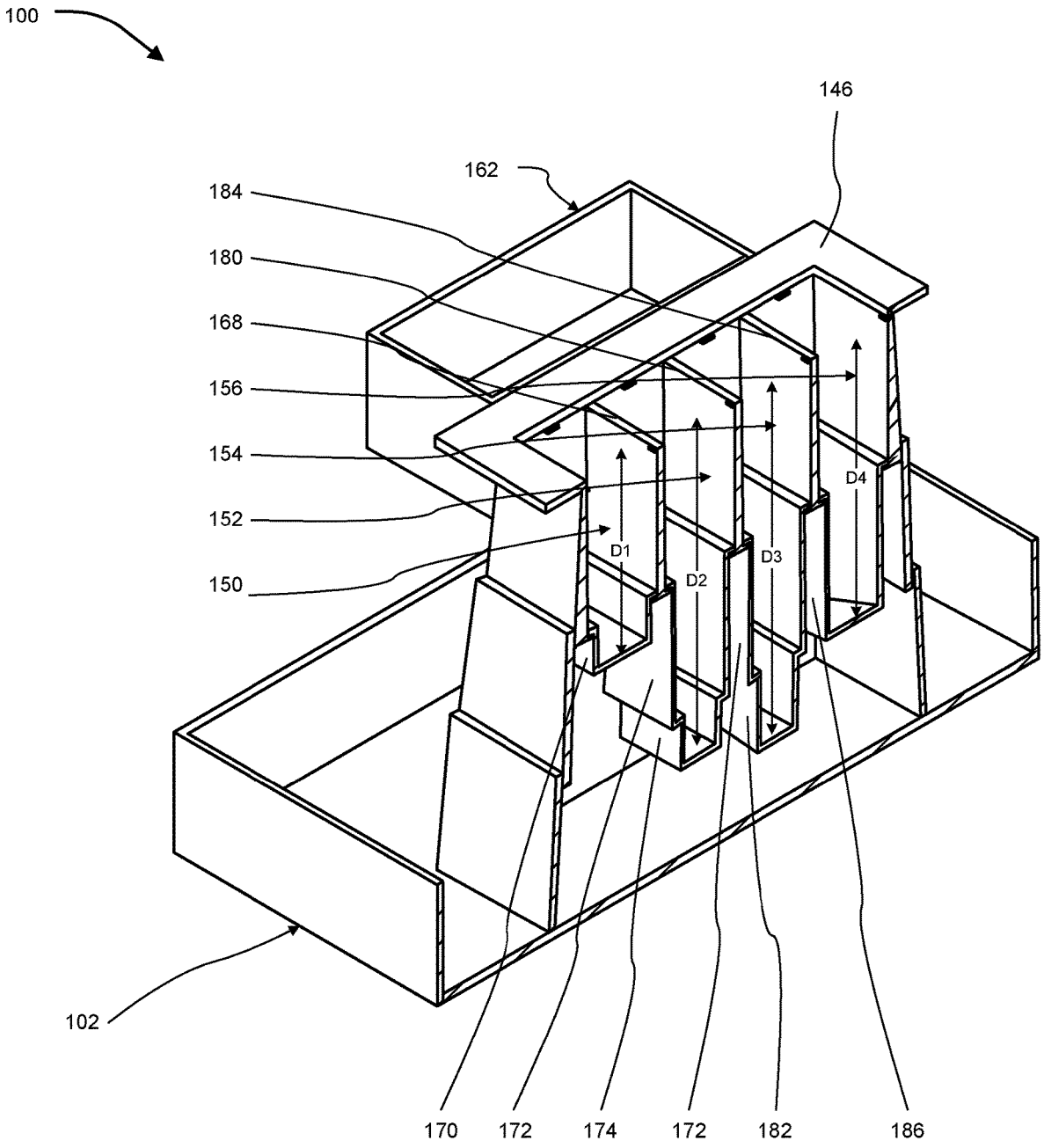
FIG. 2A is an exemplary isometric sectional view of the cosmetic and toiletry organization apparatus in the extended configuration showing details of telescopic storage members, according to an embodiment described herein.
Figure 2B:
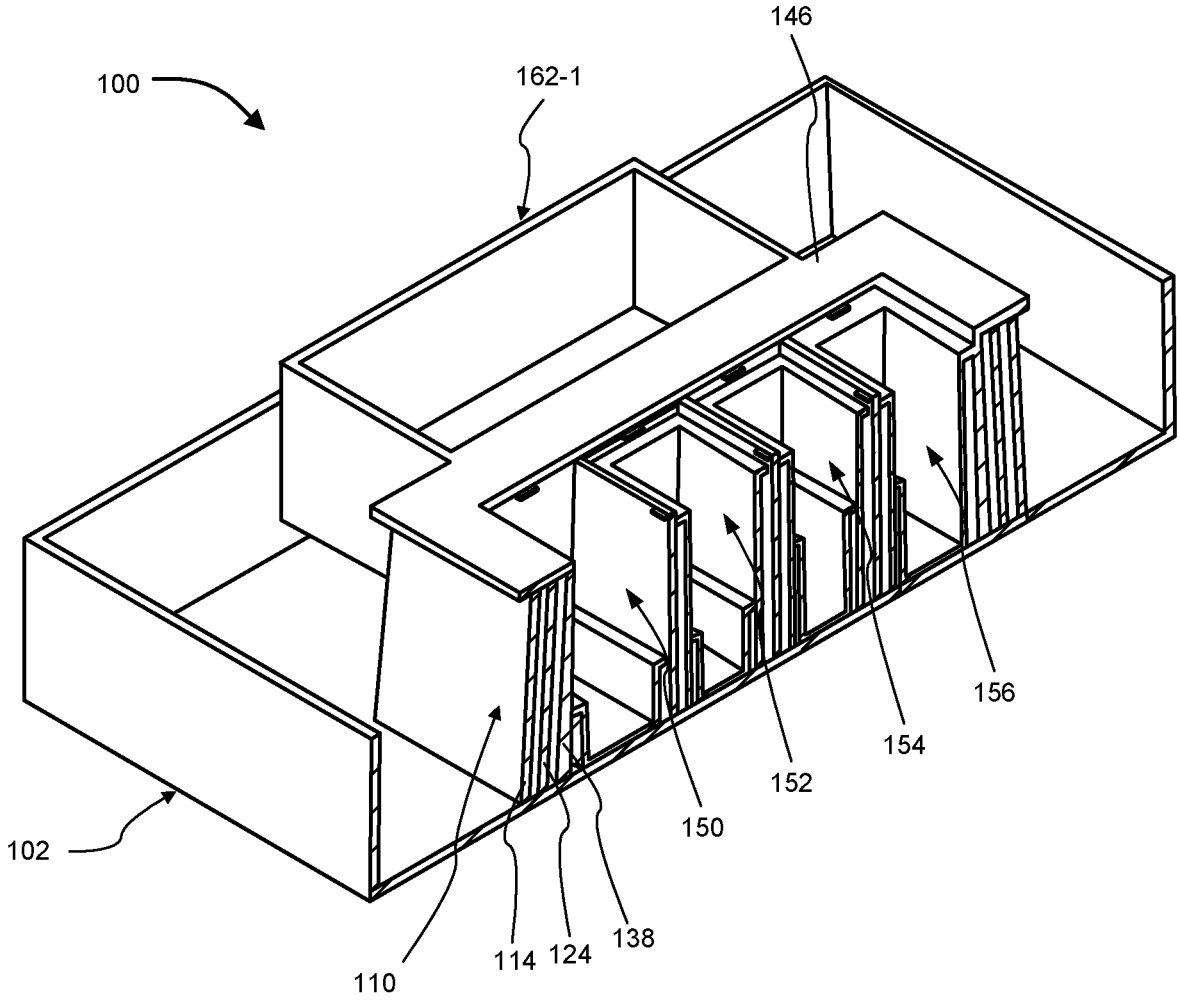
FIG. 2B is an exemplary isometric sectional view of the cosmetic and toiletry organization apparatus in the storage configuration, according to an embodiment described herein.

In one embodiment, the uppermost telescopic column 136 may incorporate one or more partition walls, such as a first partition wall 168, a second partition wall 180 and a third partition wall 184. The partition walls may divide an inner space of the uppermost telescopic column 136 into a plurality of openings, such as a first opening 188, a second opening 190, a third opening 192 and a fourth opening 194. The openings 188, 190, 192, 194 may accommodate one or more telescopic storage members as shown in FIGS. 2A and 2B. The telescopic storage members are configured for telescopic movement within the corresponding openings 188, 190, 192, 194 such that when the uppermost telescopic column 136 is in the extended configuration of the apparatus 100, shown in FIG. 1A, the telescopic storage members extend downward within the corresponding openings 188, 190, 192, 194. The downward telescopic movement of the telescopic storage members results in providing storage cavities when the apparatus 100 is in the extended configuration, such as storage cavities 150, 152, 154, 156 shown in FIG. 2A. Each storage cavity 150, 152, 154, 156 may have a storage cavity depth with a corresponding depth, D1, D2, D3, D4 that is greater than a height of the apparatus 100 in the storage configuration.

Additionally, when the telescopic column assembly 110 includes more than one telescopic column, such as uppermost telescopic column 136 and intermediate telescopic column 122, the height of the apparatus 100, when in the extended configuration, may be more than two times the height of the apparatus 100 when in the storage configuration. Accordingly, the telescopic storage members may also comprise an intermediate telescopic storage member, such as intermediate telescopic storage member 172, along with a lower storage member, such as second lower storage member 174 or third lower storage member 182, configured in the second opening 190 and the third opening 192 respectively (refer to FIG. 2A), such that in the storage configuration of the apparatus 100, the lower storage members 174, 182 and the intermediate telescopic storage members 172 nest within corresponding openings 190 and 192. In the extended configuration of the apparatus 100, a depth of such storage cavities, defined as a vertical distance from a top surface of the flange member 146 to a bottom surface of the cavity, may be greater than two times the height of the apparatus 100, defined as a vertical distance from the top surface of the flange member 146 to a bottom surface of the base 104 of the tray 102, when the apparatus 100 is in the storage configuration.

In alternate configurations, the telescopic storage members may comprise only lower storage members, such as 170, 186 configured in the first opening 188 and the fourth opening 194 respectively (refer to FIG. 2A). In the extended configuration of the apparatus 100, a depth of such storage cavities may be less than two times the height of the apparatus 100 in the storage configuration.

The intermediate telescopic storage member 172 may be of hollow construction with a sidewall extending from a lower edge to an upper edge, and may have open upper end and lower end. The sidewall may have a substantially uniform thickness. The lower storage members 170, 174, 182, 186 may be tray shaped having a bottom plate and substantially vertical walls configured along a perimeter of the bottom plate extending upward from the bottom plate.

Figure 1B:
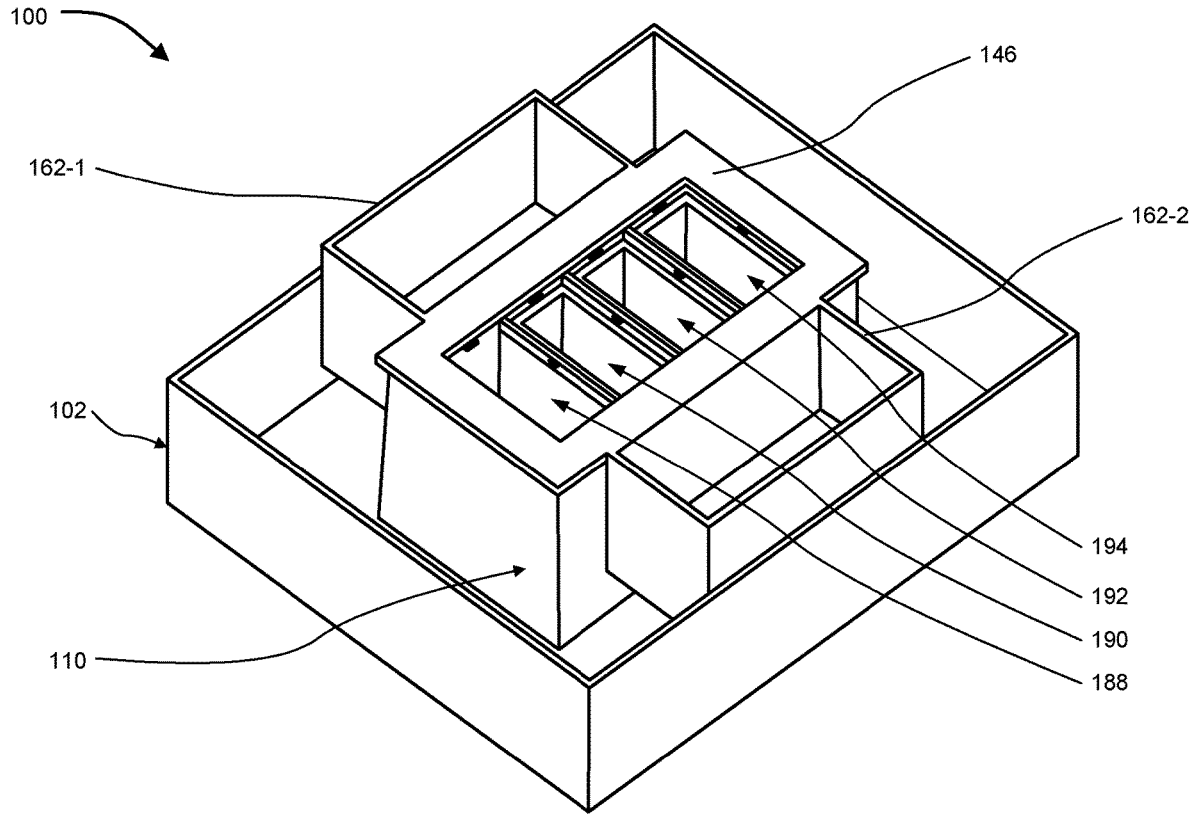
FIG. 1B is an exemplary isometric view of the cosmetic and toiletry organization apparatus in a storage configuration, according to the embodiments described herein.

The apparatus 100 can further include at least one storage member, such as storage member 162-1 and 162-2 (collectively referred to as storage member 162) coupled to a flange member 146, which extends along an upper end of the sidewall of the uppermost telescopic column 136. The storage members 162 may extend outward away from the uppermost telescopic column 136. In addition, a top surface of the storage member 162 may be coplanar with the top surface of the flange member 146 as shown in FIGS. 1A and 1B.

The storage member 162 may be tray shaped having a bottom plate 164 and substantially vertical walls 166 (refer to FIG. 2B) configured along a perimeter of the bottom plate 164 extending upward from the bottom plate 164. The bottom plate 164 and the walls 166 may have a substantially uniform thickness.

While the exemplary illustrations of FIGS. 1A to 6B illustrate two storage members 162-1 and 162-2 located along opposite longitudinal sides of the uppermost telescopic column 136, the storage members 162 may be arranged along the transverse sides of the uppermost telescopic column 136. As another option, the storage members 162 may be arranged along both the longitudinal sides and transverse sides of telescopic column 136. In addition, while the illustrated embodiment in FIGS. 1A to 6B show a rectangular shape for tray 102, the telescopic column assembly 110, the openings 188, 190, 192, 194 and the storage cavities 150, 152, 154, 156, the apparatus 100 may have other shapes, such as circular, oval, triangular, or other geometric shape, and all such variations are well within the scope of the present disclosure without any limitations. For example, tray 102 may be a rectangular shaped to permit more storage on the lower level. In one example, the tray may be 2.5 inches on two, opposing sides while the remaining two, opposing sides are approximately 2 inches. Of course, other size variations are well within the scope of the present disclosure without any limitations.

Figure 3A:
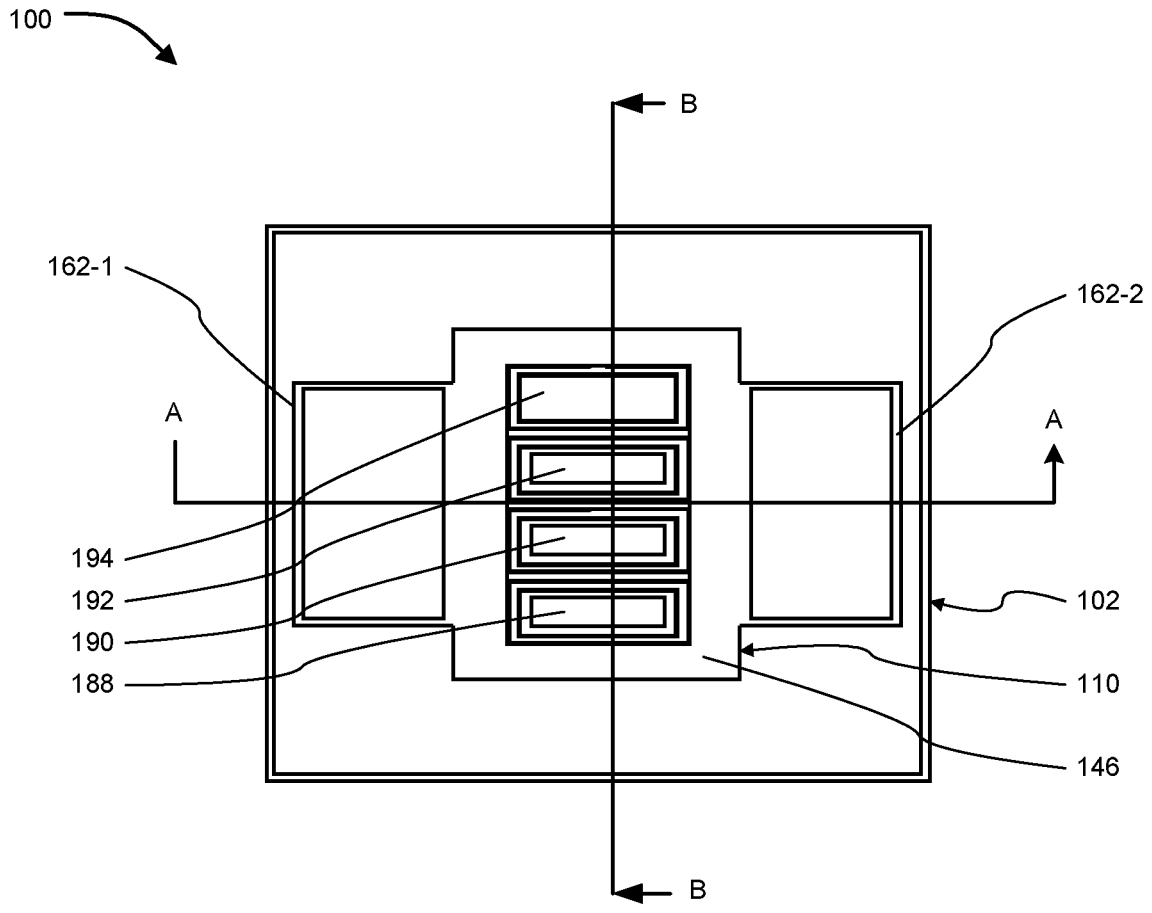
FIG. 3A is an exemplary top view of the cosmetic and toiletry organization apparatus, according to the embodiments described herein.
Figure 3B:
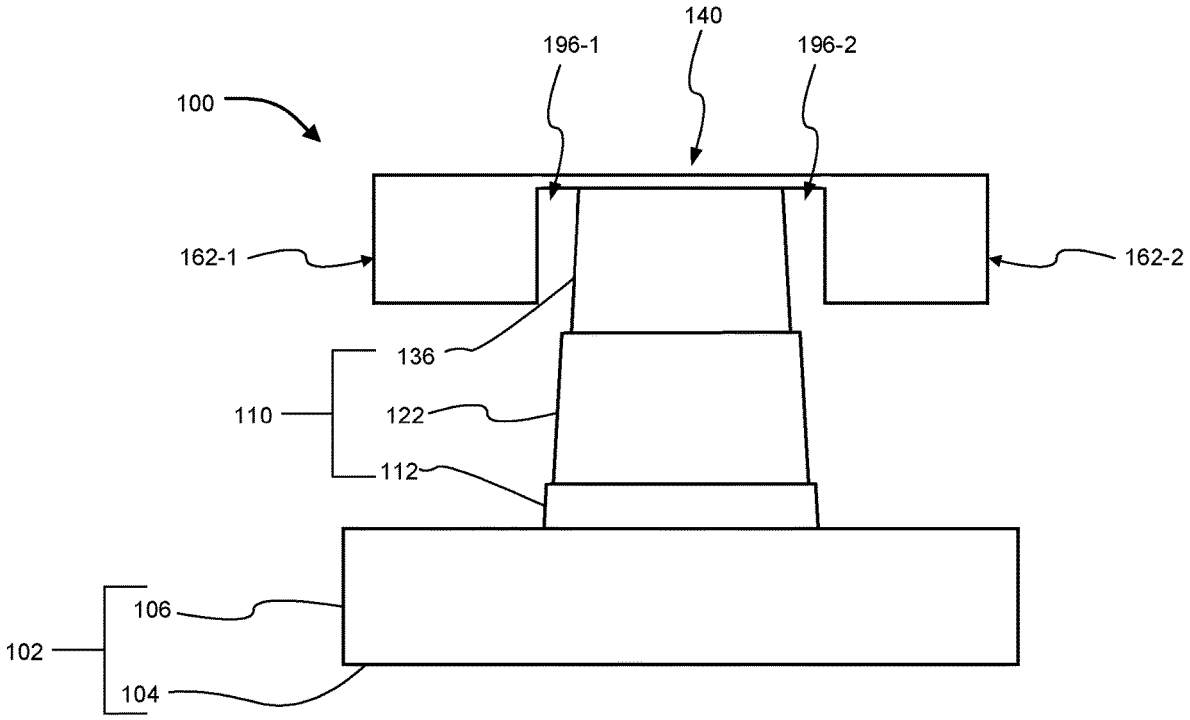
FIGS. 3B and 3C are exemplary side and front views respectively of the cosmetic and toiletry organization apparatus in the extended configuration, according to the embodiments described herein.
Figure 3C:
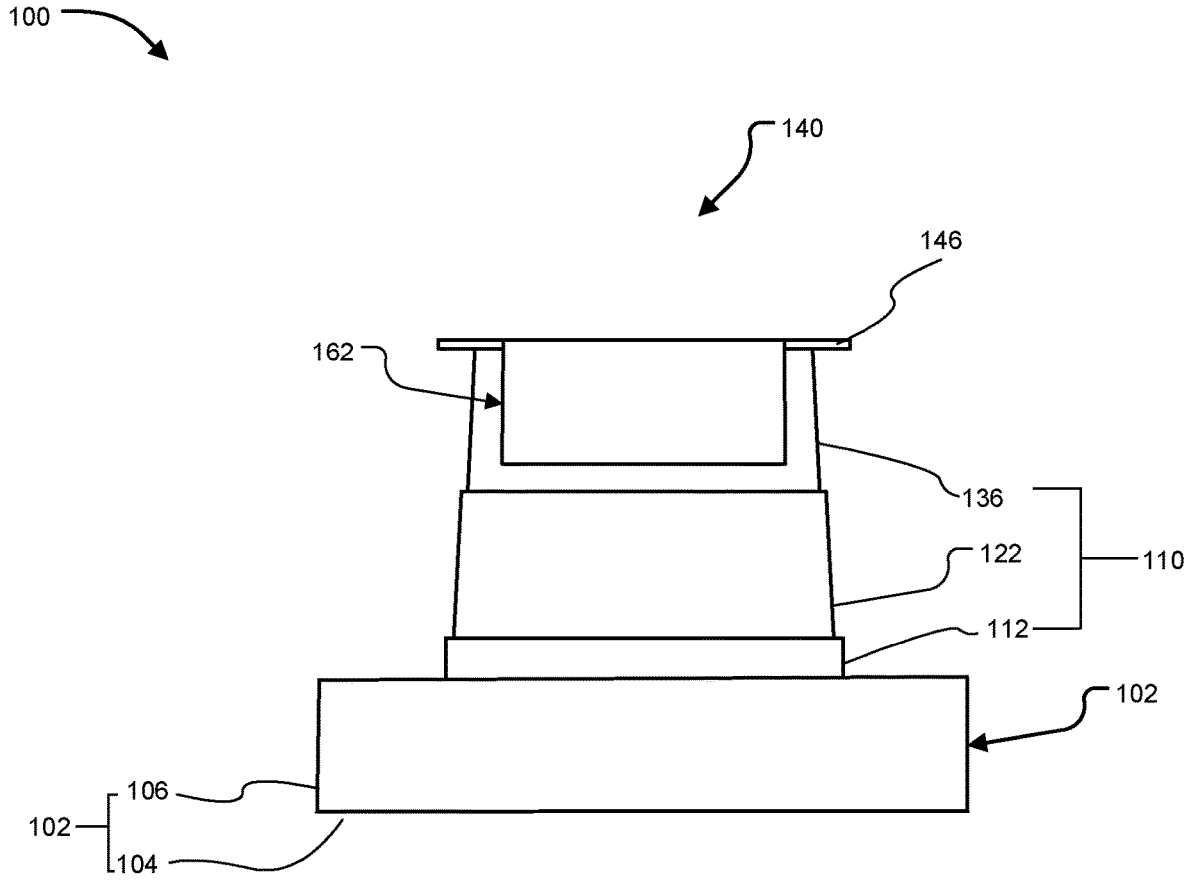
Figure 4A:
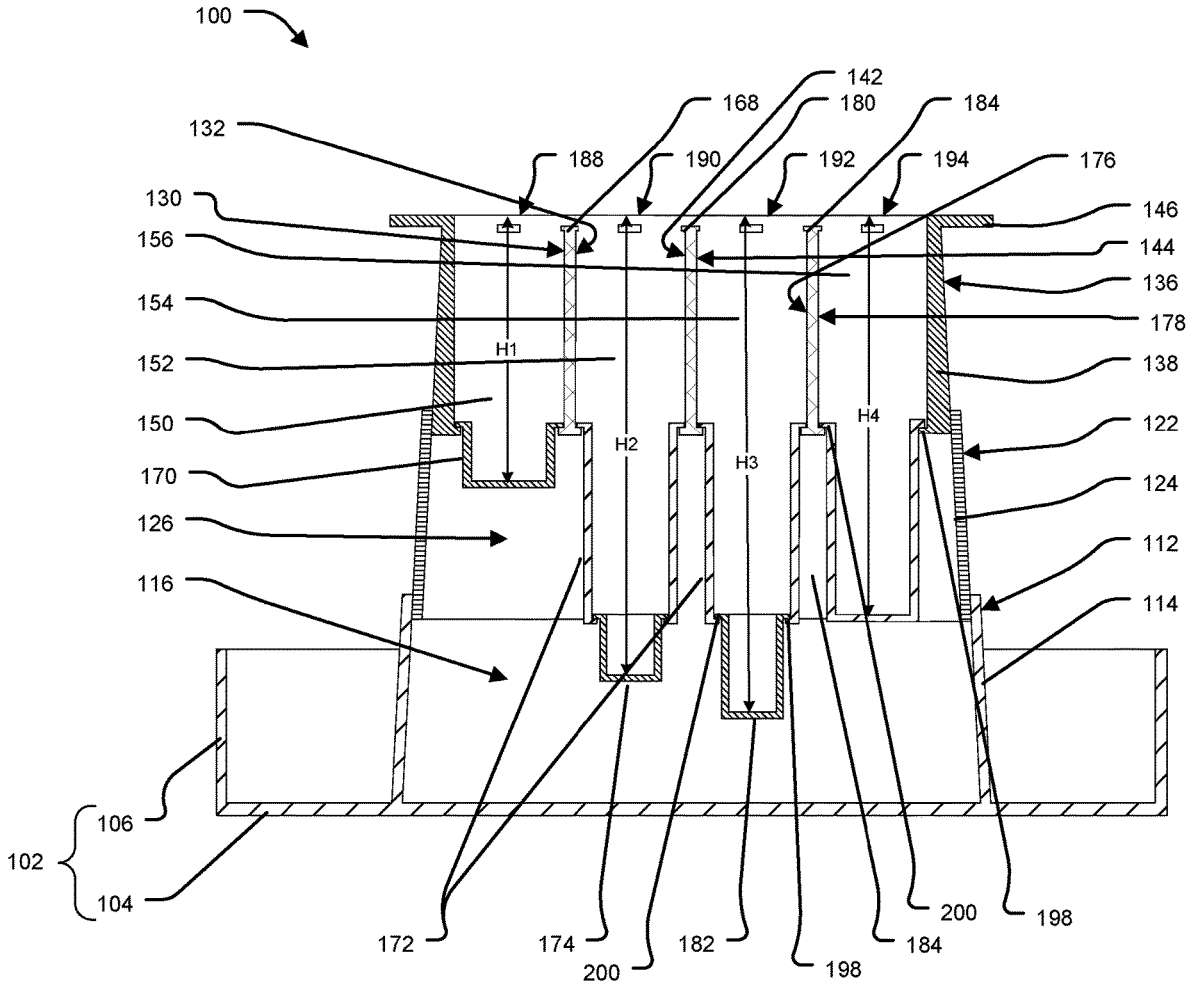
FIGS. 4A and 4B are exemplary sectional views along a longitudinal direction and a transverse direction respectively, of the cosmetic and toiletry organization apparatus in the extended configuration, according to the embodiments described herein.
Figure 4B:
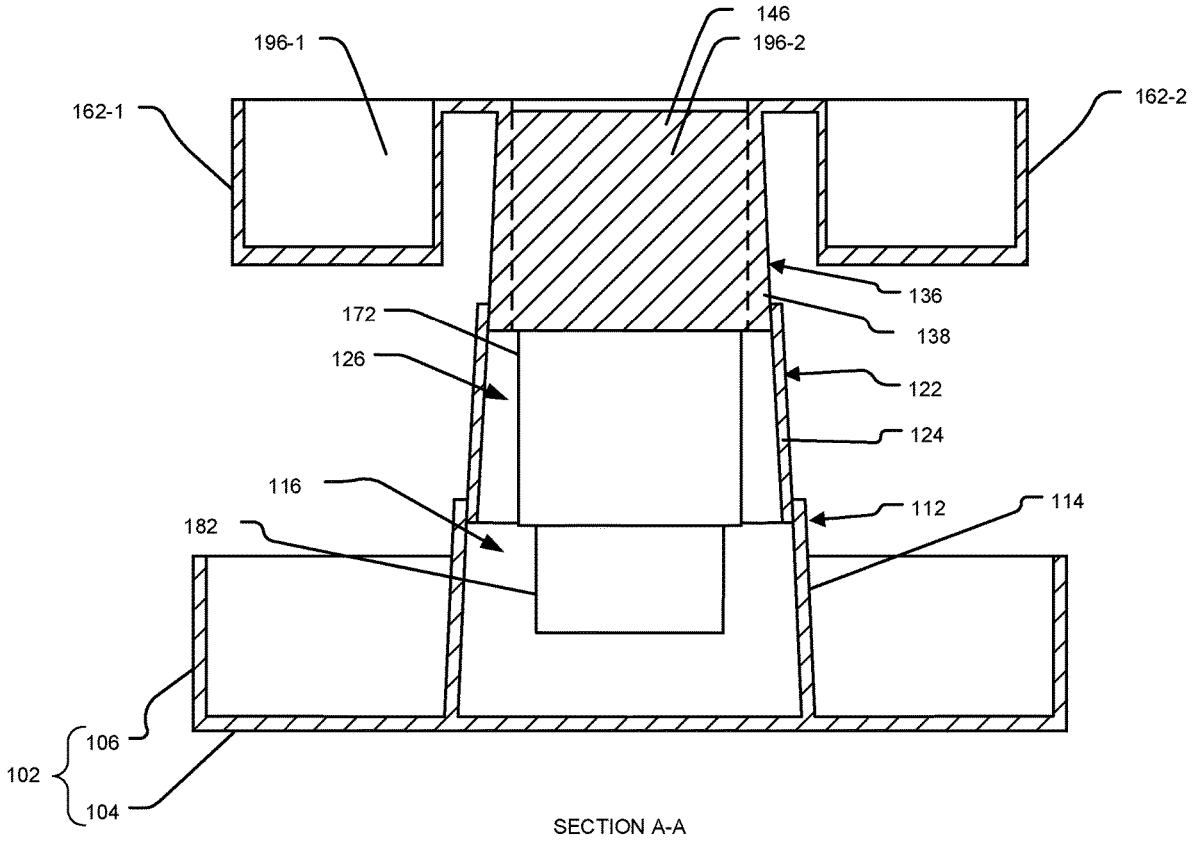

The storage members 162-1, 162-2 may be spaced from the outer side of the sidewall of the uppermost telescopic column 136 forming a relief gap, such as relief gaps 196-1 and 196-2 respectively (collectively referred to as relief gap 196) shown in FIGS. 3B and 4B. The relief gap 196 may enable nesting of the one or more telescopic columns 122 and 136 within the base column 112 when the apparatus is moved to the storage configuration, as shown in FIG. 6B.

Figure 6A:
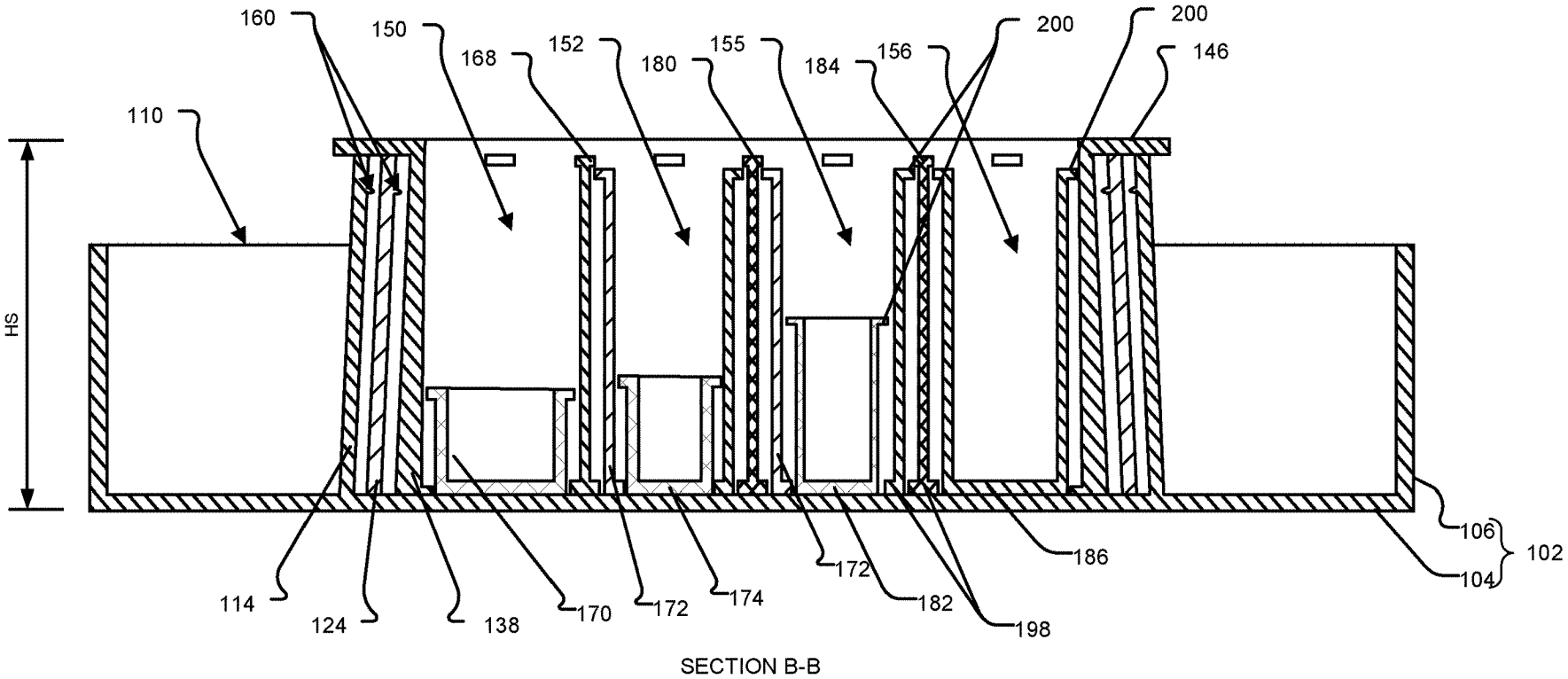
FIGS. 6A and 6B are exemplary sectional views along the longitudinal direction and the transverse direction respectively, of the cosmetic and toiletry organization apparatus in the storage configuration, according to the embodiments described herein.
Figure 6B:
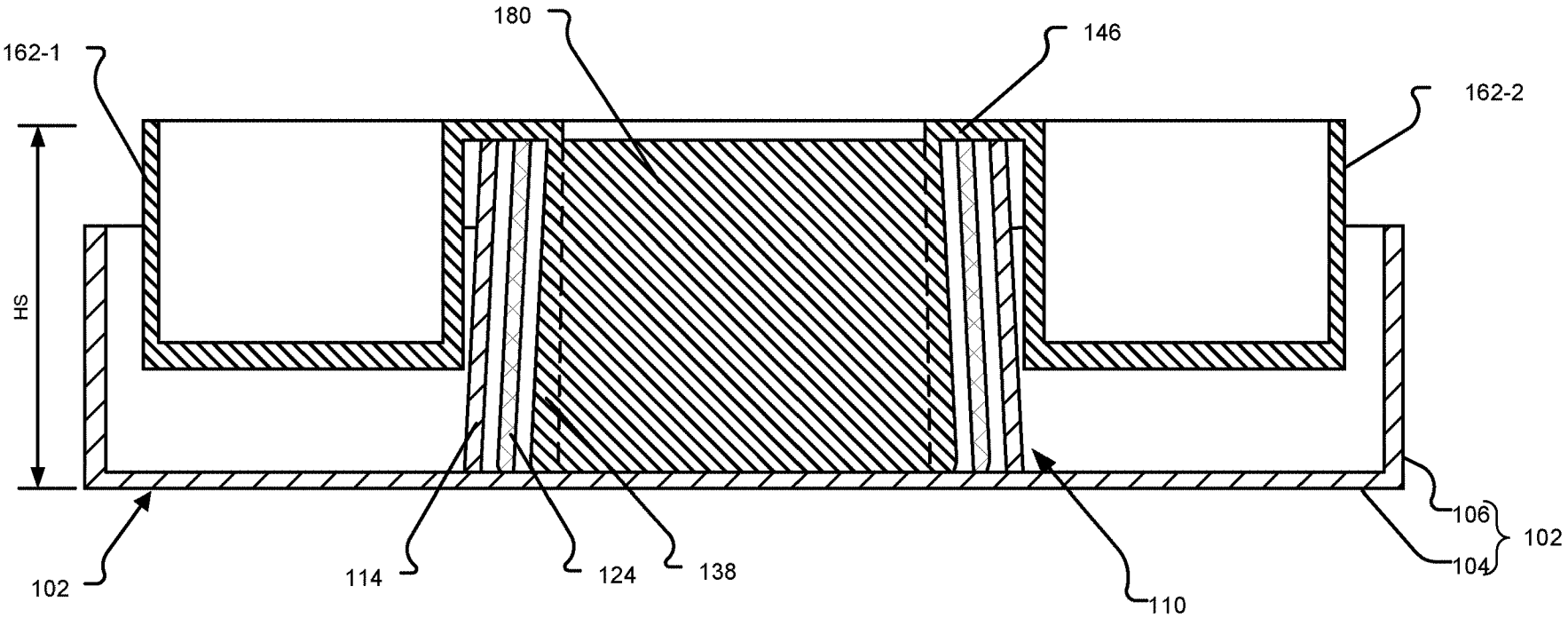

The storage member 162 may be configured such that in the storage configuration of the apparatus 100, the storage member 162 is accommodated within the tray 102, as shown in FIGS. 1B, 2B, 5A and 6B, to enable the column assembly 110 to fully collapse without any hindrance. For example, a height of the storage member 162 may be limited by distance of the top surface of the flange member 146 from an upper surface of the base 104 of the tray 102, as shown in FIG. 6B where, in the storage configuration of the apparatus 100, may have a gap as shown between underside of the storage member 162 and the upper surface of the base 104.

The apparatus 100 may also comprise a cover (not shown) to cover the apparatus 100 in the storage configuration. The cover may engage with the outer sidewalls 106 of the apparatus 100, and may be lockable. In application, the cosmetic and toiletry items may be stored in the tray 102 and the storage member 162 after the apparatus 100 has been collapsed to the storage configuration, and thereafter the cover may be placed over the apparatus and locked to enable carrying of the apparatus 100 with the cosmetic and toiletry items stored therein.

Referring now to FIGS. 2A and 4A, each of the openings 188, 190, 192, 194 may accommodate a telescopic storage member to provide a plurality of storage cavities 150, 152, 154, 156. The telescopic storage members of different configurations may be provided in different openings 188, 190, 192, 194 to achieve a plurality of storage cavities 150, 152, 154, 156, each having a different storage cavity depth in the extended configuration of the apparatus 100, to store cosmetic and toiletry items of different sizes.

For example, the plurality of storage cavities may include a first storage cavity 150, a second storage cavity 152, a third storage cavity 154, and a fourth storage cavity 156. The first storage cavity 150 may have a first opening 188 defined by a first partition wall 168 configured between opposite interior sides of a sidewall 138 of the uppermost telescopic column 136. The first storage cavity 150 may further include a first lower telescopic storage member 170 that is slidably engaged to an interior surface of sidewall 138 and a first interior surface 130 of the first partition wall 168. The storage member 170 may also include a bottom surface that defines the bottom surface of the first storage cavity 150.

The second exemplary storage cavity 152 may include a second opening 190 defined between the first partition wall 168 and a substantially parallel second partition wall 180 arranged between the opposite interior sides of the sidewall 138 of the uppermost telescopic column 136. The second storage cavity 152 may further include an intermediate telescopic storage member 172 slidably engaged to a second interior surface 132 of the first partition wall 168 and a first interior surface 142 of the second partition wall 180. A second lower storage member 174 may be slidably engaged to an inner surface of the intermediate telescopic storage member 172. The second lower storage member 174 may also include a bottom surface that defines the bottom surface of the second storage cavity 152.

The third exemplary storage cavity 154 may include a third opening 192 defined between the second partition wall 180 and a substantially parallel third partition wall 184 configured between the opposite interior sides of the sidewall 138 of the uppermost telescopic column 136. The third storage cavity 154 may further include the intermediate telescopic storage member 172 slidably engaged to a second surface 144 of the second partition wall 180 and a first surface 176 of the third partition wall 184, and a third lower storage member 182 slidably engaged to the inner surface of the intermediate telescopic storage member 172. The third lower storage member 182 may also include a bottom surface that defines the bottom surface of the third storage cavity 154.

The exemplary fourth storage cavity 156 may include a fourth opening 194 defined between the third partition wall 184, and an interior surface of the sidewall 138 of the uppermost telescopic column 136. The fourth storage cavity 156 may further include a fourth lower storage member 186 slidably engaged to a second surface 178 of the third partition wall 184 and the interior surface of the sidewall 138. The fourth lower storage member 186 may include a bottom surface that defines the bottom surface of the fourth storage cavity 156.

Additionally, as the columns 122, 136 extend upward to move the apparatus 100 from the storage configuration to the extended configuration, gravity may cause the lower storage members 170, 174, 182, 186 to remain stationary or move downward relative to the flange member 146 putting each of the storage members 170, 174, 182, 186 into their proper location to form the plurality of storage cavities 150, 152, 154, 156.

Figure 4C:
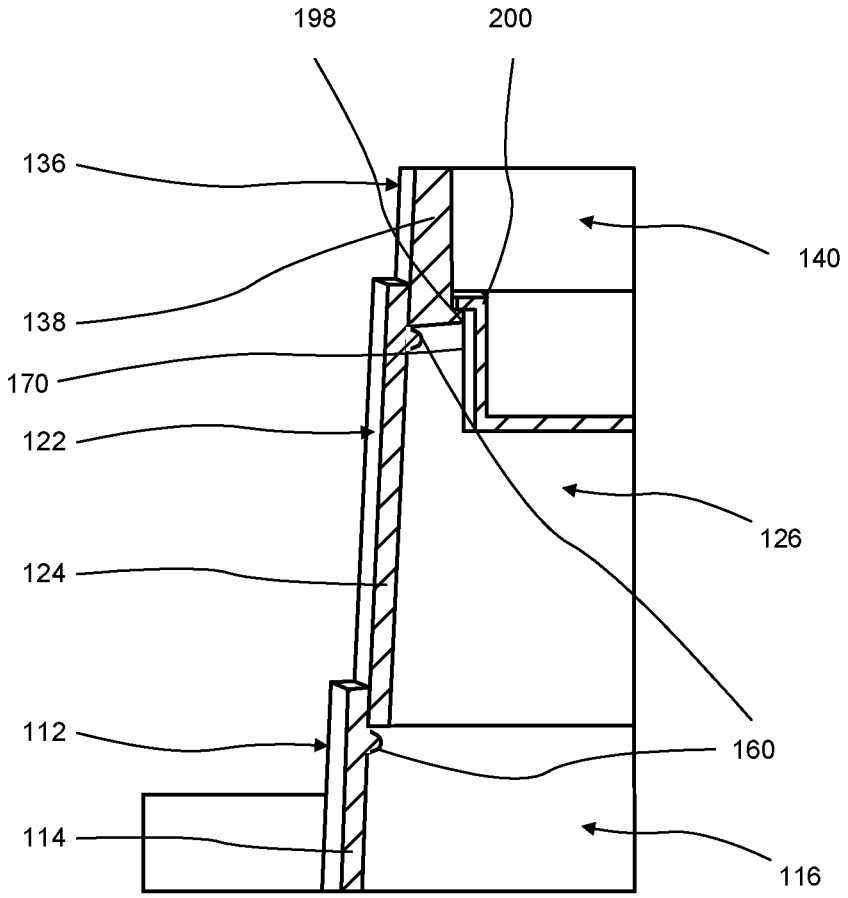
FIG. 4C is a partial sectional view of an alternate embodiment of the cosmetic and toiletry organization apparatus in the extended configuration, according to the embodiments described herein.
Figure 5A:
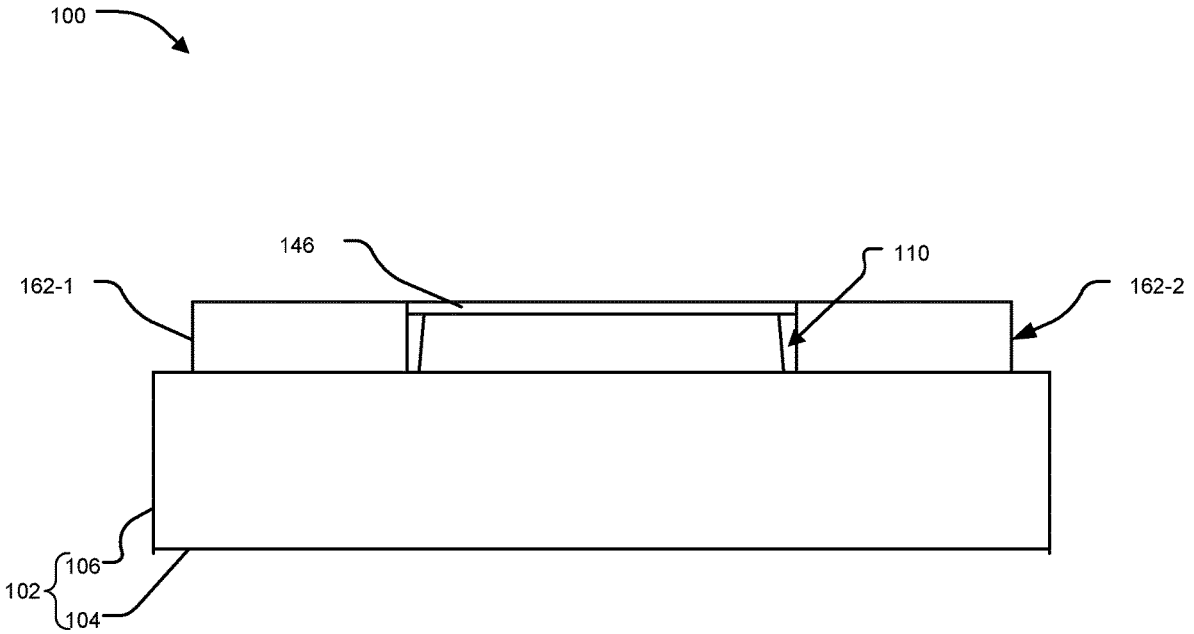
FIGS. 5A and 5B are exemplary side and front views respectively of the cosmetic and toiletry organization apparatus in the storage configuration, according to the embodiments described herein.
Figure 5B:
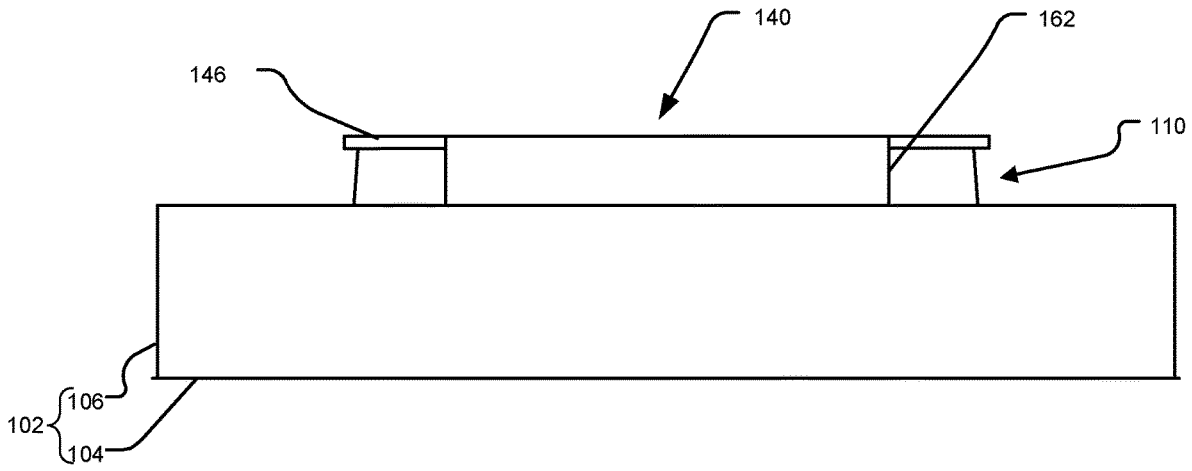

As shown in FIGS. 4A, 4C and 6A, the interior surfaces of the sidewall 138, and interior surfaces 130, 132, 142, 144, 176, 178 of the partition walls 168, 180, 184 that define openings 188, 190, 192, 194 and the inner surfaces of the intermediate telescopic storage members 172 may include inward projecting flanges 198 to support the respective intermediate telescopic storage member 172 or the corresponding lower storage members 170, 174, 182, 186 in the extended configuration of the apparatus 100. The inward projecting flanges 198 may be located near a respective lower end to engage with a corresponding outwardly extending flange 200 located at an upper end of each of the corresponding intermediate telescopic storage members 172 and the lower storage members 170, 174, 182, 186.

Referring to FIG. 4A, when the apparatus 100 is in the extended configuration, the second storage cavity 152 and the third storage cavity 154 may have respective storage cavity depths D2 and D3, which are greater than two times the height HS of the apparatus 100, defined as a vertical distance from the top surface of the flange member 146 to a bottom surface of the base 104 of the tray 102, when the apparatus 100 is in the storage configuration. Also, when the apparatus 100 is in the extended configuration, the second storage cavity depth D2 may be different than the third storage cavity depth D3. Furthermore, the first storage cavity 150 and the fourth storage cavity 156 may have respective storage cavity depths D1 and D4. In some configurations, the first storage cavity 150 and the fourth storage cavity 156 may have a smaller depth than the depths of the second and third storage cavities 152, 154. As shown in the exemplary embodiment of FIGS. 1A-6B, each of the storage cavities 150, 152, 154, 156 may have different depths when the apparatus is in the extended configuration. Thus, the apparatus 100 may have storage cavities of different depths to meet vertical storage requirements of different height cosmetic and toiletry items. Alternatively or optionally, each or some of the storage cavities may have the same depth when the apparatus is in the extended configuration.

FIGS. 2B, 6A, and 6B illustrate that when the apparatus 100 in the storage configuration, the depths of storage cavities 150, 152, 154, 156 may all have the same depth.

FIGS. 2A, 4A, and 4B show details of the telescopic column assembly 110. The base column 112 of the telescopic column assembly 110 may include a sidewall 114 spaced inward from the outer sidewall 106 extending upward from the base 104 of the tray 102. The base column 112 may include a base opening 116 bound by the sidewall 114 of the base column 112. The intermediate telescopic column 122 may be moveably or slidably engaged with the base telescopic column 112 through the base opening 116, and may be defined by a sidewall 124. The intermediate telescopic column 122 may include an intermediate opening 126 bound by the sidewall 124 of the intermediate telescopic column 122. The uppermost telescopic column 136 may be moveably coupled with the intermediate telescopic column 122 through the intermediate opening 126, and include a sidewall 138. The uppermost telescopic column 136 may include an uppermost opening 140 bound by the sidewall 138 of the uppermost telescopic column 136.

When the apparatus 100 is in the storage configuration, the uppermost telescopic column 136 may nest within the intermediate opening 126 of the intermediate telescopic column 122, and the intermediate telescopic column 122 may nest within the base opening 116 of the base column 112 as shown in FIGS. 6A and 6B.

In order to retain the uppermost telescopic column 136 and the intermediate telescopic column 122 in the extended configuration, each of the base column 112 and the intermediate telescopic column 122 may incorporate an engaging member 160 located proximate the top edge of the sidewall 114 and the sidewall 124, as shown in of FIG. 4C. The engaging member 160 may protrude inward out of the respective sidewalls 114, 124, such that in the extended configuration of the apparatus 100, the engaging members 160 prevent the apparatus 100 from collapsing by providing a mechanical stop to prevent any accidental downward movement of the corresponding sidewall 114, 124. For example, the mechanical stop provided by the engaging members 160 may prevent downward movement of the sidewall 138 of the uppermost telescopic column 136 relative to the sidewall 124 of the intermediate telescopic column 122, and the sidewall 124 of the intermediate telescopic column 122 relative to the sidewall 114 of the base column 112.

The apparatus 100 may be collapsed or minimized to the storage configuration by applying a vertically oriented collapsing force to overcome the mechanical stop and allow the sidewalls 114, 124, 138 to move with respective to each other. Alternatively, in some embodiments, the sidewalls 114, 124, 138 may be substantially smooth or planar such that the apparatus is held in the extended configuration by frictional forces between the respective sidewalls 114, 124, 138.

The base column 112, the intermediate telescopic column 122 and the uppermost telescopic column 136 may have a tapered shape having a larger cross section at the lower end than the cross section at the corresponding upper end. The tapered shape may enable a free downward movement of the columns once they disengage from the corresponding engaging member 160. Alternatively, each telescopic columns may have vertically oriented walls with a substantially constant cross-sectional shape from the lower end to the upper end.

In some embodiments, the cosmetic and toiletry organizing apparatus 100 may be configured without the intermediate telescopic column 122 and the intermediate telescopic storage members 172. Such a configuration of the apparatus may still provide advantages of having, in the extended configuration of the apparatus 100, storage cavities having depths that are greater than the height, HS, of the apparatus 100 in the storage configuration.

Accordingly, the telescopic column assembly 110 and telescopic storage members may have varying storage cavity depths that may be greater than at least two times the height, HS, of the apparatus 100 in the storage configuration. The apparatus 100 can be implemented to configure multiple storage cavities having varying depths to meet varying requirements of storing different cosmetic and toiletry items that may have different lengths or heights. Specifically, the storage cavities of different depths allow organizing of the items vertically so that they are readily visible for quick access. For example, a number of basic cosmetics that may be organized within the apparatus 100 may include items, such as categories including blush brushes, eyebrow brushes, eyelash brushes, eyeliner brushes, eyeshadow brushes, fan or bronzer brushes, powder brushes, concealer, eyebrow pencil, eyelash curler, eyeliner pencil, eyeliner powder, eyeshadow, foundation, glitter, Kleenex/tissue, lipstick, lipstick liner, mascara, moisturizer, pencil sharpener, powder/bronzer, powder puff, primer, Q-Tips, rouge, sponges, and tweezers. Each cosmetic category may generally have its own specific shape and size, and may require a storage cavity having a matching depth for proper vertical storage so that it is readily visible, and can be readily retrieved, when required. Therefore, a cosmetic and toiletry storage apparatus based on the disclosure meets this basic requirement for a meaningful storage of the cosmetic and toiletry items, at the same time enabling conversion to a convenient size for carrying in the travel luggage during travel.

The apparatus 100 may be made of a lightweight material, such as a polymer, and can include an outer coating to provide an aesthetic look. The outer coating may be a customizable skin, such as a decal or decals, or coating to personalize the apparatus 100. The decal(s) may be removable to enable the user to change the appearance. In addition, labels may be installed in or near the different storage cavities to indicate item to be stored therein and personalize the apparatus in accordance with personal preferences.

In addition to organizing the cosmetic and toiletry items, the apparatus 100 may also be used to carry other essential items during travel. For example, a removable plastic medicine holder may fit into a section of the apparatus 100, such as in the storage member 162 or the tray 102. To meet the requirement of storing additional items, the apparatus 100 may be configured for attaching add-on sections, such as by coupling to the base 104 of the apparatus, when needed. The add-on section can be an additional drawer that affixes to the base.

To enable convenience of use, the apparatus 100 may also include a swivel mechanism coupled to the base 104 so that the user can rotate the apparatus 100 to a desired orientation for convenience in accessing a desired item.

In further embodiments, the outer surface of the outer sidewall 106 or the sidewall 114 of the base column 112 may be used to affix/support an adjustable arm with a mirror using a suction cup or other adherence means—e.g., an adhesive strip, an adhesive device, or other means. Affixing a mirror may enable a user to view themselves while applying make-up or installing contact lenses. The suction cups may also be used to support removable hooks to hold jewelry like necklaces, bracelets, watch etc.

In further embodiments, a wireless charger could be integrated or embedded into the apparatus. The wireless charger could be enabled in the base and connect to an outlet, using a releasable power cord that can be wrapped up and stored in the apparatus 100. The wireless charger could be configured to charge a single device or multiple devices simultaneously.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

What is claimed is:

1. An organization apparatus comprising:

a base;

a base column extending perpendicularly from the base;

one or more telescopic columns configured with the base column for movement of an uppermost telescopic column of the one or more telescopic columns between a storage configuration and an extended configuration, wherein when in the storage configuration, the one or more telescopic columns are nested within the base column, wherein when in the extended configuration, the one or more telescopic columns extend at least partly out of the base column;

wherein the uppermost telescopic column includes a plurality of openings defined by one or more partition walls configured between opposite interior sides of the uppermost telescopic column; and wherein at least one opening of the plurality of openings accommodates one or more telescopic storage members such that when the apparatus is in the extended configuration, the one or more telescopic storage members move downward within a corresponding opening to provide at least one storage cavity having, in the extended configuration of the apparatus, a storage cavity depth that is greater than a height of the apparatus in the storage configuration.

2. The organization apparatus of claim 1, wherein the one or more telescopic columns include the uppermost telescopic column and at least one intermediate telescopic column and, and wherein height of the apparatus in the extended configuration is greater than two times the height of the apparatus in the storage configuration.

3. The organization apparatus of claim 2, wherein at least one of the one or more telescopic storage members comprises a lower storage member and at least one intermediate telescopic storage member, wherein the lower storage member and the at least one intermediate telescopic storage member are configured such that when the apparatus is in the storage configuration, the lower storage member and the at least one intermediate telescopic storage member nest within the corresponding opening.

4. The organization apparatus of claim 1, wherein the apparatus includes an outer sidewall extending substantially perpendicular to the base along a perimeter of the base, such that the base and the outer sidewall define a tray having storage space between the base column and the outer sidewall to support the telescopic storage members when the apparatus is in the extended configuration.

5. The organization apparatus of claim 4, wherein the uppermost telescopic column includes a flange member coupled to upper end of a sidewall of the uppermost telescopic column, and at least one storage member is coupled to the flange member such that the at least one storage member extends outward away from the uppermost telescopic column with a relief gap between an outer surface of the uppermost telescopic column and the at least one storage member to enable nesting of the one or more telescopic columns within the base column.

6. The organization apparatus of claim 5, wherein the at least one storage member has a top surface that is coplanar with the top surface of the flange member.

7. The organization apparatus of claim 5, wherein the at least one storage member is configured such that in the storage configuration of the apparatus, the at least one storage member is accommodated within the tray without hindering movement of the apparatus to the storage configuration.

8. The organization apparatus of claim 4, wherein the apparatus comprises a cover configured to engage with an outer sidewall of the apparatus when the apparatus is in the storage configuration, and wherein the cover enables carrying of the apparatus with cosmetic and toiletry items stored in the tray and the storage members.

9. The organization apparatus of claim 1, wherein the telescopic storage members include an inward projecting flange that, in the extended configuration of the apparatus, contact against an inward extending flange at a lower end of the one or more partition walls.

10. An organization apparatus comprising:

a tray having a base and an outer sidewall extending perpendicularly from the base along a tray perimeter;

a telescoping column assembly comprising:

a base column defined by a sidewall spaced inward from the outer sidewall and extending upward from the base of the tray; wherein the base column includes a base opening bound by the sidewall of the base column;

an intermediate telescopic column moveably coupled with the base column through the base opening, the intermediate telescopic column defined by a sidewall and includes an intermediate opening bound by the sidewall of the intermediate column; and an uppermost telescopic column moveably coupled with the intermediate telescopic column through the intermediate opening of the intermediate telescopic column, the uppermost telescopic column defined by a sidewall and includes an uppermost opening bound by the sidewall of the uppermost telescopic column;

a flange member connected to an upper end of the sidewall of the uppermost telescopic column; and a plurality of storage cavities arranged within the uppermost opening;

wherein a first storage cavity of the plurality of storage cavities has a first storage cavity depth defined as a vertical distance from a top surface of the flange member to a bottom surface of the first storage cavity;

wherein the apparatus has a storage configuration and an extended configuration, and wherein when the apparatus is in the storage configuration, the first storage cavity depth is less than the first storage cavity depth when the apparatus is in the extended configuration;

wherein the plurality of storage cavities includes the first storage cavity, a second storage cavity, a third storage cavity, and a fourth storage cavity;

wherein the first storage cavity comprises:

a first opening defined by a first partition wall configured between opposite interior sides of sidewall of the uppermost telescopic column; and a first lower telescopic storage member slidably engaged to an interior surface of the sidewall of the uppermost telescopic column and a first interior surface of first partition wall, wherein the first lower telescopic storage member comprises the bottom surface of the first storage cavity;

wherein the second storage cavity comprises:

a second opening defined between the first partition wall and a substantially parallel second partition wall configured between the opposite interior sides of the sidewall of the uppermost telescopic column;

an intermediate telescopic storage member slidably engaged to a second interior surface of first partition wall and a first interior surface of the second partition wall; and a second lower storage member slidably engaged to an inner surface of the intermediate telescopic storage member, wherein the second lower storage member comprises a bottom surface of the second storage cavity;

wherein the third storage cavity comprises:

a third opening defined between the second partition wall and a substantially parallel third partition wall configured between the opposite interior sides of the sidewall of the uppermost telescopic column;

the intermediate telescopic storage member slidably engaged to the a second interior surface of the second partition wall and a first interior surface of the third partition wall; and a third lower storage member slidably engaged to the inner surface of the intermediate telescopic storage member, wherein the third lower storage member comprises a bottom surface of the third storage cavity; and wherein the fourth storage cavity comprises:

a fourth opening defined by the third partition wall, and an interior side of the sidewall of the uppermost telescopic column, and a fourth lower storage member slidably engaged to a second interior surface of the third partition wall and the interior surface of the sidewall of the uppermost telescopic member, wherein the fourth lower storage member comprises a bottom surface of the fourth storage cavity;

wherein each of the interior surfaces, and the intermediate telescopic storage members comprises an inward projecting flange located near a respective lower end to support a corresponding intermediate telescopic storage member or a corresponding lower storage member in the extended configuration of the apparatus by engaging with an outwardly extending flange of a corresponding intermediate telescopic storage member or a corresponding lower storage member.

11. The organization apparatus of claim 10, wherein when the apparatus is in the storage configuration, the uppermost telescopic column is nested within the intermediate opening of the intermediate telescopic column, and the intermediate telescopic column is nested within the base opening of the base column.

12. The organization apparatus of claim 10, wherein each of the base column, the intermediate telescopic column, and the uppermost telescopic column is a tapering column having a larger cross section at a lower end than a cross section at an upper end.

13. The organization apparatus of claim 12, wherein the sidewalls of the base column and the intermediate telescopic column comprise an engaging member that protrudes inward and is located proximate the top edge of the respective sidewalls, wherein in the extended configuration of the apparatus, the engaging member prevents the apparatus from collapsing by providing a mechanical stop against downward movement of the sidewall of the uppermost telescopic column relative to the sidewall of the intermediate telescopic column, and the sidewall of the intermediate telescopic column relative to the sidewall of the base column.

14. The organization apparatus of claim 10, wherein the apparatus further comprises at least one storage member coupled to the flange member extending outward away from the uppermost opening, wherein the at least one storage member has a top surface that is coplanar with the top surface of the flange member.

15. The organization apparatus of claim 10, wherein the second storage cavity and the third storage cavity respectively have a second storage cavity depth and a third storage cavity depth defined as a vertical distance from the top surface of the sidewall of the uppermost telescopic column to the bottom surface of the respective storage cavity, and wherein when the apparatus is in the extended configuration, the second storage cavity depth and the third storage cavity depth are more than two times a height of the apparatus in the storage configuration.

16. The organization apparatus of claim 10, wherein when the apparatus is in the extended configuration, a second storage cavity depth is different from a third storage cavity depth.

17. The organization apparatus of claim 10, wherein when the apparatus is in the storage configuration, all the storage cavity depths are equal.

18. A toiletry organization apparatus comprising:

a tray having a base and an outer sidewall extending perpendicularly from the base along a tray perimeter;

a telescoping column assembly comprising:

a base column defined by a sidewall spaced inward from the outer sidewall and extending upward from the base of the tray; wherein the base column includes a base opening bound by the sidewall of the base column;

an uppermost telescopic column moveably coupled with the base column through the base opening of the base column, the uppermost telescopic column defined by a sidewall and includes an uppermost opening bound by the sidewall of the uppermost telescopic column;

a flange member connected to a upper end of the sidewall of the uppermost telescopic column; and a plurality of storage cavities arranged within the uppermost opening, each of the storage cavities having a corresponding storage cavity depth defined as a vertical distance from a top surface of the flange member to a bottom surface of the corresponding storage cavity;

wherein the apparatus has a storage configuration and an extended configuration, wherein when the apparatus is in the extended configuration, the storage cavity depth of at least one of the plurality of storage cavities that is greater than a height of the apparatus in the storage configuration;

wherein at least one of the plurality of storage cavities comprises;

a first opening defined by a first partition wall configured between opposite interior surfaces of the sidewall of the uppermost telescopic column; and a lower telescopic storage member slidably engaged to one of the interior surfaces of the sidewall of the uppermost telescopic column and a first interior surface of a partition wall, wherein the lower telescopic storage member comprises the bottom surface of the at least one of the plurality of storage cavities;

wherein the first interior surface comprises an inward projecting flange located near a respective lower end to support the lower telescopic storage member that engages with an outwardly extending flange of a corresponding lower storage member when the apparatus is in the extended configuration; and wherein the apparatus further comprises at least one storage member coupled to the flange member extending outward away from the uppermost opening, wherein the at least one storage member is configured such that in the storage configuration of the apparatus, the at least one storage member is accommodated within the tray without hindering movement of the apparatus to the storage configuration.

* * * * *